US005853035A

United States Patent [19]

Rose

[11] Patent Number: 5,853,035

[45] Date of Patent: Dec. 29, 1998

[54] SLOTTED DOVETAIL HOLDING FIXTURE

[76] Inventor: Monte L. Rose, 256 E. 2050 S., Bountiful, Utah 84010-5427

[21] Appl. No.: 974,045

[22] Filed: Nov. 19, 1997

[51] Int. Cl.[6] ..... B27F 1/08; B27C 5/10

[52] U.S. Cl. ..... 144/144.1; 33/197; 144/84; 144/87

[58] Field of Search ..... 144/27, 82–87, 144/144.1, 144.51, 144.52, 367; 33/197; 409/125, 130, 132

[56] References Cited

U.S. PATENT DOCUMENTS 3,109,466 11/1963 Jones ..... 144/87
3,834,435 9/1974 McCord, Jr. ..... 144/87
4,479,523 10/1984 Peterson et al. ..... 144/87
4,787,432 11/1988 Williams ..... 144/82
5,692,861 12/1997 Stottmann ..... 144/144.1

*Primary Examiner*—W. Donald Bray

[57] ABSTRACT

A slotted dovetail holding fixture is provided including a horizontally oriented base for being clamped to a recipient surface. A vertically oriented central support is coupled adjacent a bottom edge thereof along a side edge of the base. Next provided is a clamping assembly mounted on the central support for clamping a planar piece of wood with a top edge thereof at an elevation common with the top edge of the central support. At least one template is removably mounted to the central support above the clamping assembly for allowing the forming of a dovetail tenon in the piece of wood with a router.

5 Claims, 3 Drawing Sheets

FIG. 1
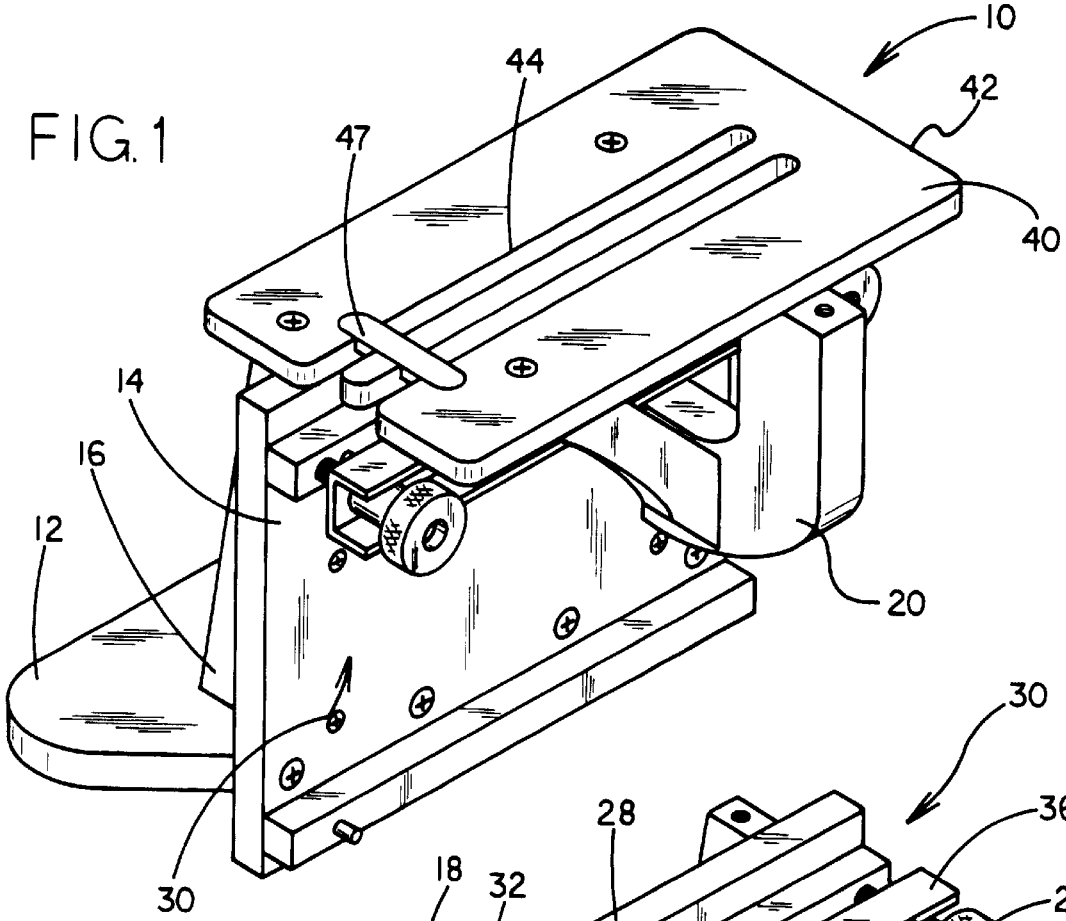
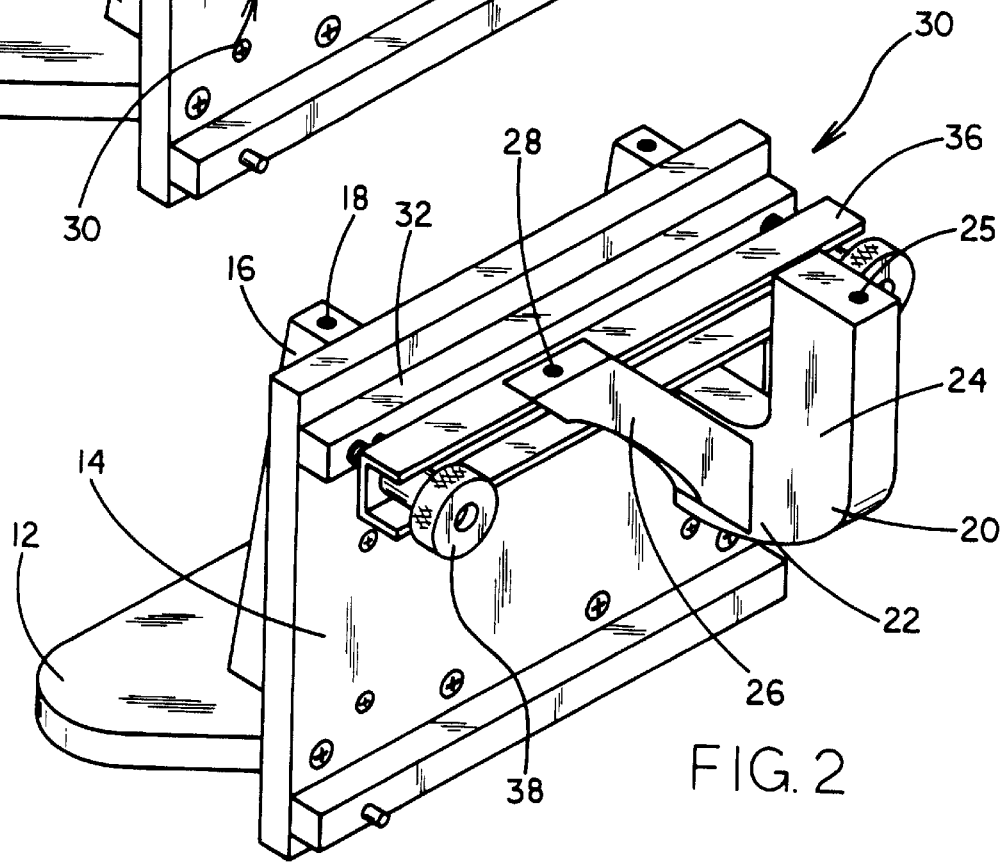
FIG. 2

FIG. 5
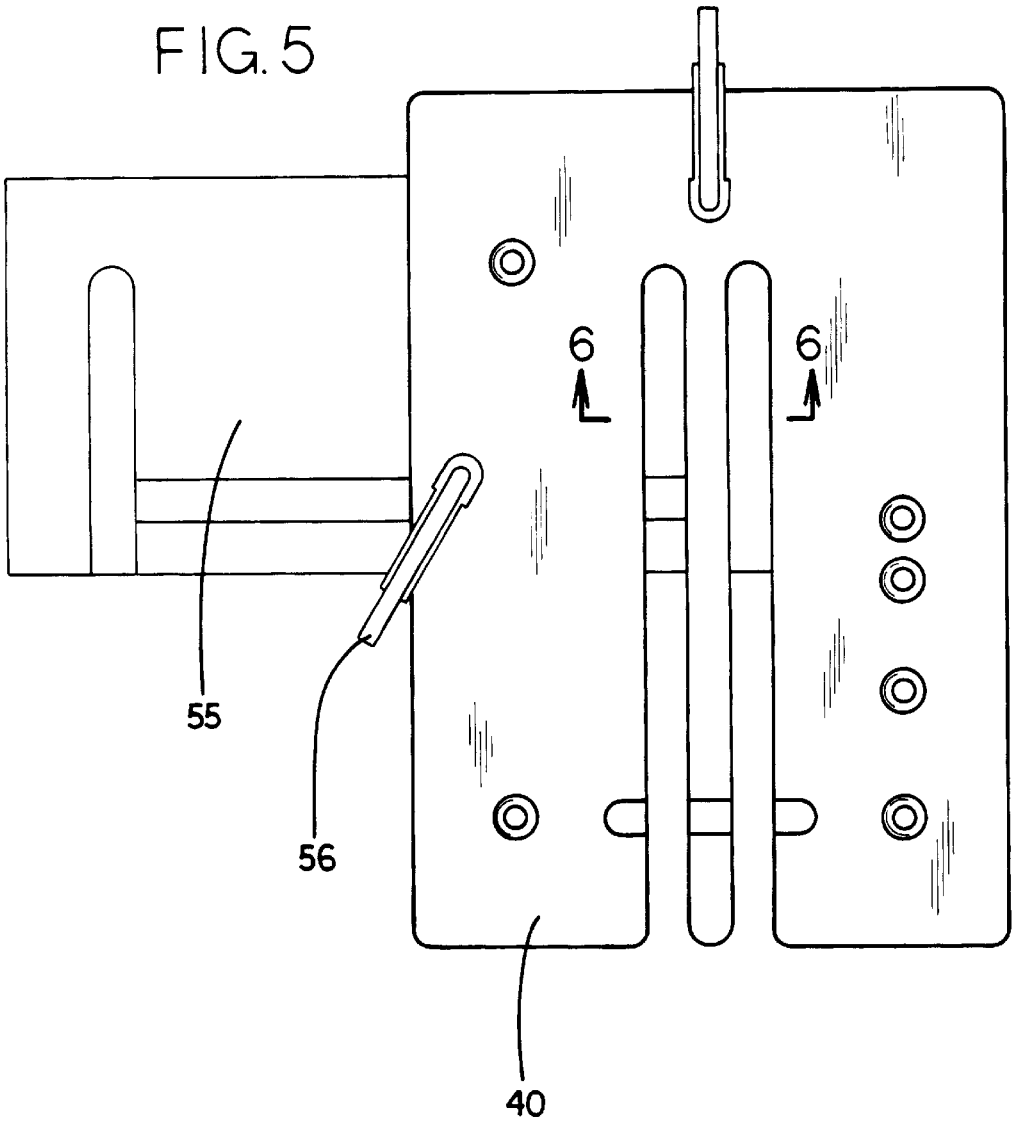
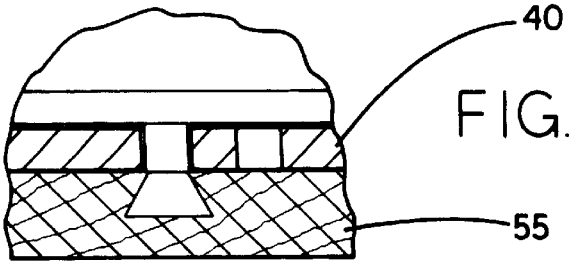
FIG. 6

SLOTTED DOVETAIL HOLDING FIXTURE

BACKGROUND OF THE INVENTION

1. Field of the Invention

The present invention relates to systems for making dovetail joints and more particularly pertains to a new slotted dovetail holding fixture for providing a portable dovetail template apparatus specifically tailored for constructing drawers with dovetail joints.

2. Description of the Prior Art

The use of systems for making dovetail joints is known in the prior art. More specifically, systems for making dovetail joints heretofore devised and utilized are known to consist basically of familiar, expected and obvious structural configurations, notwithstanding the myriad of designs encompassed by the crowded prior art which have been developed for the fulfillment of countless objectives and requirements.

Known prior art systems for making dovetail joints include U.S. Pat. No. 5,143,132; U.S. Pat. No. 4,163,465; U.S. Pat. No. 4,763,465; U.S. Pat. No. 4,763,706; U.S. Pat. No. 4,411,297; and U.S. Pat. No. 4,693,288; and U.S. Pat. No. 4,830,074.

In these respects, the slotted dovetail holding fixture according to the present invention substantially departs from the conventional concepts and designs of the prior art, and in so doing provides an apparatus primarily developed for the purpose of providing a portable dovetail template apparatus specifically tailored for constructing drawers with dovetail joints.

SUMMARY OF THE INVENTION

In view of the foregoing disadvantages inherent in the known types of systems for making dovetail joints now present in the prior art, the present invention provides a new slotted dovetail holding fixture construction wherein the same can be utilized for providing a portable dovetail template apparatus specifically tailored for constructing drawers with dovetail joints.

The general purpose of the present invention, which will be described subsequently in greater detail, is to provide a new slotted dovetail holding fixture apparatus and method which has many of the advantages of the systems for making dovetail joints mentioned heretofore and many novel features that result in a new slotted dovetail holding fixture which is not anticipated, rendered obvious, suggested, or even implied by any of the prior art systems for making dovetail joints, either alone or in any combination thereof.

To attain this, the present invention generally comprises a horizontally oriented planar base with a generally oval configuration. In use, the base is adapted for being clamped to a recipient surface. Coupled along a side edge of the base is a vertically oriented planar central support having a rectangular configuration, as shown in FIG. 3. Next provided is a pair of spaced triangle shaped mounting brackets each having a lower edge coupled to a top surface of the base in perpendicular relationship with the central support. Each mounting bracket further has a vertical side edge coupled to the central support and a top edge formed contiguous with a top edge of the central support. For reasons that will become apparent later, the top edge of each mounting bracket is equipped with a threaded bore formed therein. As best shown in FIGS. 2 & 3, a primary cantilever having a J-shaped configuration is provided. Such cantilever includes a lower horizontal member coupled to the central support on a face opposite that of the mounting brackets. The lower horizontal member resides in coplanar relationship with a first one of the mounting brackets. Coupled to an outboard end of the lower horizontal member and extended upwardly therefrom is an upper vertical member with a top face situated at an elevation common with the top edge of the mounting brackets and a threaded bore formed therein. Associated therewith is a linear secondary cantilever having a lower end coupled adjacent the outboard end of the lower horizontal member of the primary cantilever. The secondary cantilever extends upwardly and outwardly from the lower horizontal member of the primary cantilever in a plane residing in parallel with the central support. With attention still to FIGS. 2 & 3, a clamping assembly is provided including an elongated rectilinear strip with a square cross-section. The strip is coupled to the central support and spaced a predetermined distance from the top edge thereof. As shown in FIG. 2, the strip extends between side edges of the central support. The strip has a pair of bolts fixed to ends thereof which extend outwardly therefrom. Also included is a clamping bar with a pair of bores formed in ends thereof for slidably receiving the bolts. Lastly, a pair of knurled knobs each with a threaded bore are provided for threadedly engaging the bolts. Such arrangement allows the clamping of a planar piece of wood between the clamping bar and the strip with a top edge thereof spaced from and at an elevation common with the top edge of the central support. Finally, a pair of templates are provided each having a planar rectangular configuration. Each template is equipped with a plurality of bores formed therein for allowing the screwable coupling with the threaded bores of the cantilevers and mounting brackets. As shown in FIGS. 1 & 3, the templates include a first template with a pair of linear, parallel and elongated cutouts formed therein and in communication with a side edge of the first template. The cutouts of the first template are situated above a corresponding upper edge of the piece of wood clamped by the clamping assembly. In such orientation the slots are adapted for allowing the forming of a dovetail tenon in the piece of wood with a router. As shown in FIG. 4, the templates further include a second template with an oval cutout formed therein for forming a tenon in the piece of wood with a router.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new slotted dovetail holding fixture apparatus and method which has many of the advantages of the systems for making dovetail joints mentioned heretofore and many novel features that result in a new slotted dovetail holding fixture which is not anticipated, rendered obvious, suggested, or even implied by any of the prior art systems for making dovetail joints, either alone or in any combination thereof.

It is another object of the present invention to provide a new slotted dovetail holding fixture which may be easily and efficiently manufactured and marketed.

It is a further object of the present invention to provide a new slotted dovetail holding fixture which is of a durable and reliable construction.

An even further object of the present invention is to provide a new slotted dovetail holding fixture which is susceptible of a low cost of manufacture with regard to both materials and labor, and which accordingly is then susceptible of low prices of sale to the consuming public, thereby making such slotted dovetail holding fixture economically available to the buying public.

Still yet another object of the present invention is to provide a new slotted dovetail holding fixture which provides in the apparatuses and methods of the prior art some of the advantages thereof, while simultaneously overcoming some of the disadvantages normally associated therewith.

Still another object of the present invention is to provide a new slotted dovetail holding fixture for providing a portable dovetail template apparatus specifically tailored for constructing drawers with dovetail joints.

Even still another object of the present invention is to provide a new slotted dovetail holding fixture that includes a horizontally oriented base for being clamped to a recipient surface. A vertically oriented central support is coupled adjacent a bottom edge thereof along a side edge of the base. Next provided is a clamping assembly mounted on the central support for clamping a planar piece of wood with a top edge thereof at an elevation common with the top edge of the central support. At least one template is removably mounted to the central support above the clamping assembly for allowing the forming of a dovetail tenon in the piece of wood with a router.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new slotted dovetail holding fixture according to the present invention.

FIG. 2 is a perspective view of the present invention without a template attached thereto.

FIG. 5 is a top view of the first template in during its alternate use of forming a mortise in a recipient surface.

FIG. 6 is a cross-sectional view of the first template taken along line 6—6 shown in FIG. 5.

DESCRIPTION OF THE PREFERRED EMBODIMENT

Figure 3:
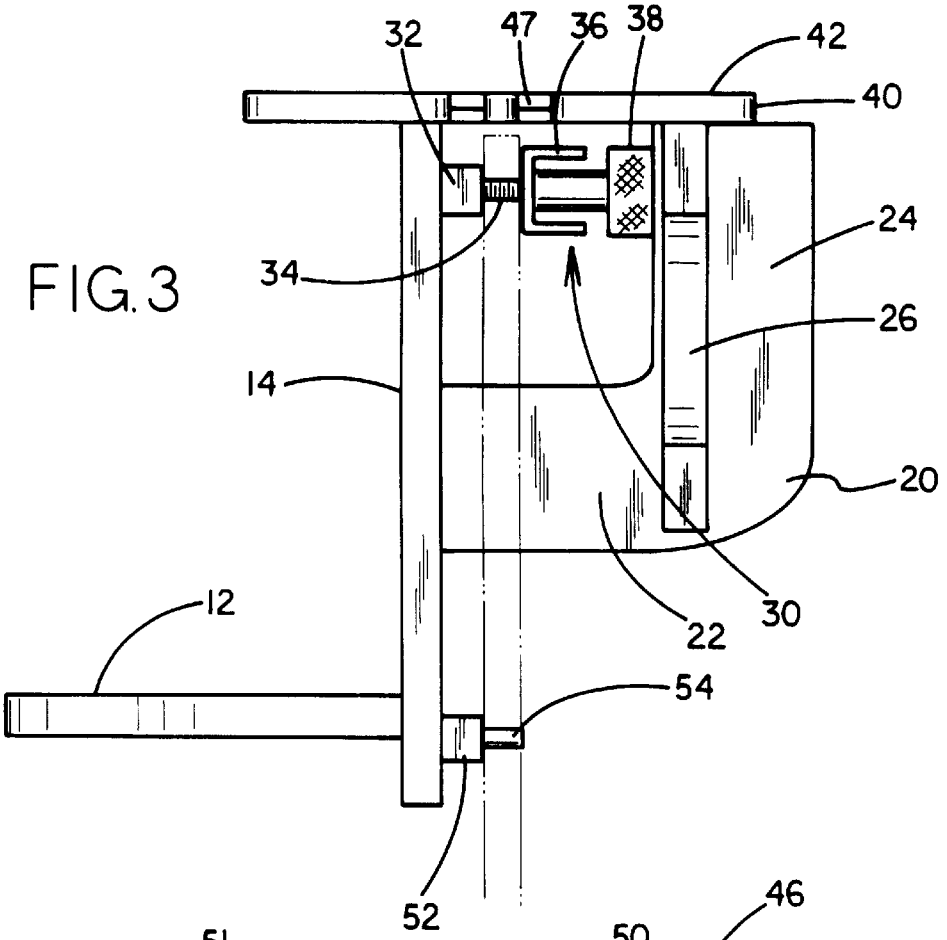
FIG. 3 is a side view of the present invention in use.

With reference now to the drawings, and in particular to FIGS. 1 through 6 thereof, a new slotted dovetail holding fixture embodying the principles and concepts of the present invention and generally designated by the reference numeral 10 will be described.

The present invention as designated as numeral 10 includes a horizontally oriented planar wood base 12 with a generally oval configuration. In use, the base is adapted for being clamped to a recipient surface via a conventional C-clamp or the like. Coupled along a side edge of the base is a vertically oriented planar central support 14 constructed from wood and having a rectangular configuration, as shown in FIG. 3. To facilitate the coupling of the base to the recipient surface, it is imperative that the same have a length greater than that of the central support. Together, the base and central support have a height of 13 inches and a width of 13 and ¾ inches.

Next provided is a pair of spaced triangle shaped mounting brackets 16 each formed of metal and having a lower edge coupled to a top surface of the base in perpendicular relationship with the central support. Each mounting bracket further has a vertical side edge coupled to the central support and a top edge formed contiguous with a top edge of the central support. For reasons that will become apparent later, the top edge of each mounting bracket is equipped with a vertically oriented threaded bore 18 formed therein.

As best shown in FIGS. 2 & 3, a wooden primary cantilever 20 having a J-shaped configuration is provided. Such cantilever includes a lower horizontal member 22 coupled to the central support on a face opposite that of the mounting brackets. The lower horizontal member resides in coplanar relationship with a first one of the mounting brackets. Coupled to an outboard end of the lower horizontal member and extended upwardly therefrom is an upper vertical member 24 with a top face situated at an elevation common with the top edge of the mounting brackets. The top face has a threaded bore 25 formed therein.

Associated therewith is a linear secondary cantilever 26 formed of metal and having a lower end coupled adjacent the outboard end of the lower horizontal member of the primary cantilever. The secondary cantilever extends upwardly and outwardly from the lower horizontal member of the primary cantilever in a plane residing in parallel with the central support. Similar to the primary cantilever, the secondary cantilever has a threaded bore 28 formed on a top thereof.

With attention still to FIGS. 2 & 3, a metal clamping assembly 30 is provided including an elongated rectilinear strip 32 with a square cross-section. The strip is coupled to the central support and spaced a predetermined distance from the top edge thereof. As shown in FIG. 2, the strip extends between side edges of the central support. The strip has a pair of bolts 34 fixed to ends thereof which extend outwardly therefrom. Also included is a clamping bar 36 with a pair of bores formed in ends thereof for slidably receiving the bolts. As shown in FIG. 3, the clamping bar has a U-shaped cross-section rotated 90 degrees. Lastly, a pair of knurled knobs 38 each with a threaded bore are provided for threadedly engaging the bolts. Such arrangement allows the clamping of a planar piece of wood between the clamping bar and the strip with a top edge thereof spaced from and at an elevation common with the top edge of the central support.

Figure 4:
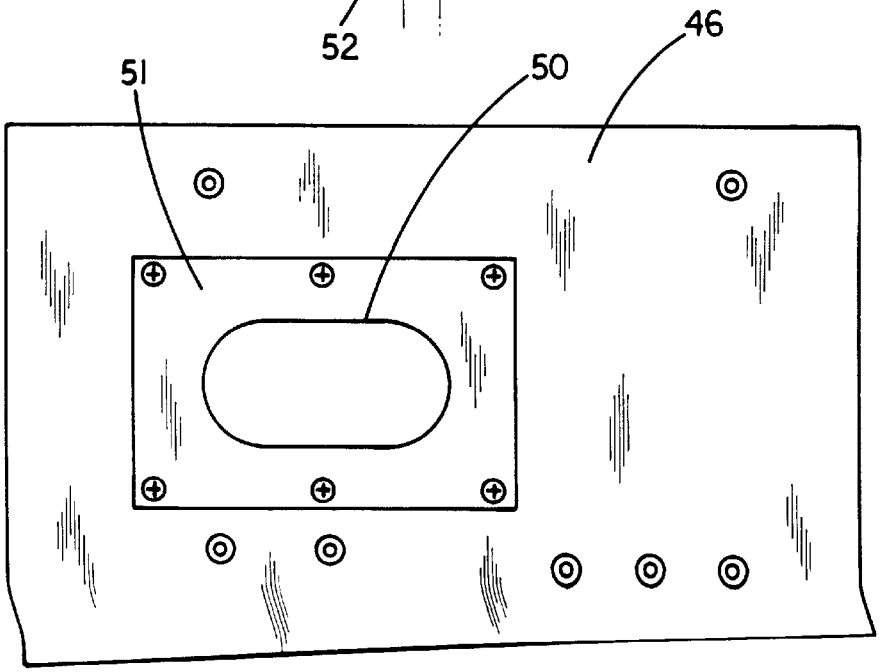
FIG. 4 is a top view of a second template associated with the present invention.

Also included is a pair of metal templates 40 each having a planar rectangular configuration. Each template is equipped with a plurality of bores formed therein for allowing the screwable coupling with the threaded bores of the cantilevers and mounting brackets. As shown in FIGS. 1 & 3, the templates include a first template 42 with a pair of linear, parallel and elongated cutouts 44 formed therein and in communication with a side edge of the first template. The cutouts of the first template are situated above a corresponding upper edge of the piece of wood clamped by the clamping assembly. In such orientation the slots are adapted for allowing the forming of a dovetail tenon in the piece of wood with a router. As an option, a cross bar 47 may be removably situated within a recess formed across the elongated cutouts adjacent the side edge of the template for strengthening purposes. As shown in FIG. 4, the templates further include a second template 46 with an oval cutout 50 formed therein for forming a tenon in the piece of wood with a plunge router. The oval cutout is preferably formed in a Plexiglas insert 51 removably coupled in coplanar relationship with the second template.

Shown in FIG. 3 is yet another rectilinear strip 52 with a square cross-section coupled below that associated with the clamping assembly. A cylindrical post 54 is coupled to the strip and extends outwardly therefrom at a point adjacent a side edge of the central support. During use, the post acts as a stop.

It should be noted that the removable nature of the first template is critical for allowing the same to be removably coupled to another piece of wood 55. Such coupling is preferably afforded by means of a plurality of C-shaped clamps 56. When the template is coupled to such piece of wood, the router may be maneuvered along one of the cut outs for forming a mortise in the wood. Such mortise serves to be mated with the tenon formed in the other piece of wood.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A slotted dovetail holding fixture comprising, in combination:

a horizontally oriented planar base with a generally oval configuration for being clamped to a recipient surface;

a vertically oriented planar central support having a rectangular configuration coupled adjacent a bottom edge thereof along a side edge of the base;

a pair of spaced triangle shaped mounting brackets each having a lower edge coupled to a top surface of the base in perpendicular relationship with the central support, a vertical side edge coupled to the central support, and a top edge formed contiguous with a top edge of the central support with a threaded bore formed therein;

a primary cantilever having a J-shaped configuration with a lower horizontal member coupled to the central support on a face opposite that of the mounting brackets and in coplanar relationship with a first one of the mounting brackets and an upper vertical member coupled to an outboard end of the lower horizontal member and extending upwardly therefrom with a top face situated at an elevation common with the top edge of the mounting brackets and a threaded bore formed therein;

a linear secondary cantilever having a lower end coupled adjacent the outboard end of the lower horizontal member of the primary cantilever and extending upwardly and outwardly therefrom in a plane residing in parallel with the central support;

a clamping assembly including an elongated rectilinear strip with a square cross-section coupled to the central support spaced a predetermined distance from the top edge thereof and extending between side edges thereof, the strip having a pair of bolts fixed to ends thereof and extending outwardly therefrom, a clamping bar with a pair of bores formed in ends thereof for slidably receiving the bolts, and a pair of knurled knobs each with a threaded bore for threadedly engaging the bolts thereby allowing the clamping of a planar piece of wood between the clamping bar and the strip with a top edge thereof spaced from and at an elevation common with the top edge of the central support; and a pair of templates each having planar rectangular configuration with a plurality of bores formed therein for allowing the screwable coupling thereof with the threaded bores of the cantilevers and mounting brackets, the templates including a first template with a pair of linear, parallel and elongated cutouts formed therein and in communication with a side edge of the first template, the cutouts being situated above a corresponding upper edge of the piece of wood clamped by the clamping assembly for allowing the forming of a dovetail tenon in the piece of wood with a router, the templates further including a second template with an oval cutout formed therein for forming a tenon in the piece of wood with a router.

2. A slotted dovetail holding fixture comprising, in combination:

a horizontally oriented base for being clamped to a recipient surface;

a vertically oriented central support coupled adjacent a bottom edge thereof along a side edge of the base;

a clamping assembly mounted on the central support for clamping of a planar piece of wood with a top edge thereof at an elevation common with the top edge of the central support;

at least one template removably mounted to the central support above the clamping assembly and extending from the vertically oriented central support in a direction opposite from that in which the horizontally oriented base extends for allowing the forming of a dovetail tenon in the piece of wood with a router;

a primary cantilever having a J-shaped configuration with a lower horizontal member coupled to the central support for supporting the template; and a secondary cantilever having a lower end coupled adjacent an outboard end of the lower horizontal member of the primary cantilever and extending upwardly and outwardly therefrom in a plane residing in parallel with the central support for further supporting the template.

3. A slotted dovetail holding fixture as set forth in claim 2 wherein at least one of the templates has an oval cut out formed therein.

4. A slotted dovetail holding fixture as set forth in claim 2 wherein at least one of the templates has cut outs which include a pair of linear, parallel and elongated cutouts formed therein.

5. A slotted dovetail holding fixture as set forth in claim 2 wherein the clamping assembly includes an elongated rectilinear strip coupled to the central support and extending between side edges thereof, the strip having a pair of bolts fixed to ends thereof and extending outwardly therefrom, a clamping bar with a pair of bores formed in ends thereof for slidably receiving the bolts, and a pair of knobs each with a threaded bore for threadedly engaging the bolts.

* * * * *